US009062480B2

(12) United States Patent
Litch

(10) Patent No.: US 9,062,480 B2
(45) Date of Patent: Jun. 23, 2015

(54) GASKET AND FLANGE DESIGN ON A REFRIGERATOR FOR BETTER ENERGY EFFICIENCY

(75) Inventor: Andrew David Litch, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 158 days.

(21) Appl. No.: 13/584,857

(22) Filed: Aug. 14, 2012

(65) Prior Publication Data

US 2014/0047775 A1 Feb. 20, 2014

(51) Int. Cl.

| | |
|---|---|
| ***E06B 7/16*** | (2006.01) |
| ***E05C 19/16*** | (2006.01) |
| ***F25D 23/08*** | (2006.01) |

(52) U.S. Cl.

CPC ..... *E05C 19/161* (2013.01); *F25D 23/087* (2013.01)

(58) Field of Classification Search

CPC .... F25D 23/082; F25D 23/087; E05C 19/161
USPC ..... 312/296, 401, 405, 405.1, 406.1, 116; 220/592.02, 592.06, 592.07; 49/478.1, 49/489.1, 483.1, 457.1
See application file for complete search history.

(56) References Cited

U.S. PATENT DOCUMENTS

| | | | | |
|---|---|---|---|---|
| 2,084,204 | A | | 6/1937 | Knight |
| 2,100,811 | A | | 11/1937 | Marshall |
| 2,256,206 | A | | 9/1941 | Knight |
| 2,321,589 | A | | 6/1943 | Erland Af Kleen |
| 2,704,698 | A | | 3/1955 | Patterson |
| 2,729,863 | A | | 1/1956 | Kurtz |
| 2,745,259 | A | | 5/1956 | Saunders |
| 2,899,256 | A | * | 8/1959 | Kelley ..... 312/296 |
| 2,988,788 | A | * | 6/1961 | Saponara ..... 49/492.1 |
| 3,243,855 | A | | 4/1966 | Houvener |
| 3,353,321 | A | | 11/1967 | Heilweil |
| 3,601,463 | A | | 8/1971 | Watt |
| 3,869,873 | A | | 3/1975 | Thomas |
| 4,114,065 | A | * | 9/1978 | Horvay ..... 312/406 |
| 4,162,571 | A | * | 7/1979 | Horvay ..... 29/460 |
| 4,831,780 | A | | 5/1989 | Bockwinkel |
| 4,891,912 | A | | 1/1990 | Bockwinkel |
| 5,033,182 | A | * | 7/1991 | Winterheimer et al. ..... 29/460 |
| 5,269,601 | A | * | 12/1993 | Williams et al. ..... 312/406.1 |
| 5,289,657 | A | | 3/1994 | Kiel |
| 5,476,318 | A | * | 12/1995 | Yingst et al. ..... 312/405 |
| 5,600,966 | A | | 2/1997 | Valence et al. |
| 5,737,939 | A | | 4/1998 | Valence et al. |
| 6,056,383 | A | | 5/2000 | Banicevic et al. |
| 6,485,122 | B2 | | 11/2002 | Wolf et al. |
| 2002/0184828 | A1 | * | 12/2002 | Park et al. ..... 49/489.1 |
| 2003/0222553 | A1 | * | 12/2003 | Lee et al. ..... 312/296 |
| 2008/0303400 | A1 | | 12/2008 | Kim |
| 2009/0079141 | A1 | * | 3/2009 | Qiang et al. ..... 277/650 |
| 2009/0243453 | A1 | * | 10/2009 | Kang et al. ..... 312/405 |

* cited by examiner

*Primary Examiner* — James O Hansen

(57) ABSTRACT

A sealing assembly for a refrigerator includes a refrigerator cabinet liner defining a receiving slot having a plurality of thermal breaks disposed therein. An elongate tubular gasket includes a magnetic portion and an engagement projection disposed in the receiving slot. A cabinet door is adapted for abutment with the elongate tubular gasket proximate the magnetic portion, thereby forming a substantially airtight compartment inside the refrigerator.

6 Claims, 4 Drawing Sheets

GASKET AND FLANGE DESIGN ON A REFRIGERATOR FOR BETTER ENERGY EFFICIENCY

BACKGROUND OF THE INVENTION

The present invention generally relates to a gasket and flange design on a refrigerator, and more specifically to a gasket and flange design on a refrigerator for better efficiency.

BRIEF SUMMARY OF THE INVENTION

In one aspect of the present invention, a sealing assembly for a refrigerator includes a refrigerator cabinet liner defining a receiving slot having a plurality of thermal breaks disposed therein. An elongate tubular gasket includes a magnetic portion and an engagement projection disposed in the receiving slot. A cabinet door is adapted for abutment with the elongate tubular gasket proximate the magnetic portion, thereby forming a substantially airtight compartment inside the refrigerator.

In another aspect of the present invention, a sealing assembly for a refrigerator includes a refrigerator cabinet liner defining a receiving slot. A flexible seal includes a flange disposed in the receiving slot. A magnetic strip is disposed in one of the refrigerator cabinet liner and the flexible seal. A conductive member is disposed in the other of the refrigerator cabinet liner and the flexible seal. A door is adapted for abutment with the flexible seal proximate the magnetic strip, thereby forming a substantially airtight compartment inside the refrigerator.

In another aspect of the invention, a sealing assembly for a refrigerator includes a refrigerator cabinet liner defining a receiving slot having a thermal break disposed therein. A flexible seal includes a flange disposed in the receiving slot. An L-shaped fascia member is disposed on the cabinet liner adjacent to the receiving slot. A door is adapted for abutment with the flexible seal, thereby forming a substantially airtight compartment inside the refrigerator.

Yet another aspect of the present invention includes a sealing assembly for a refrigerator that includes a receiving slot with thermal breaks. A flexible seal is provided and configured for engagement with the receiving slot and includes an elongate magnetic strip therein. The flexible seal allows for a substantially airtight seal of the refrigerator door with a refrigerator cabinet liner.

These and other features, advantages, and objects of the present invention will be further understood and appreciated by those skilled in the art by reference to the following specification, claims, and appended drawings.

DETAILED DESCRIPTION OF EMBODIMENTS

Figure 1:
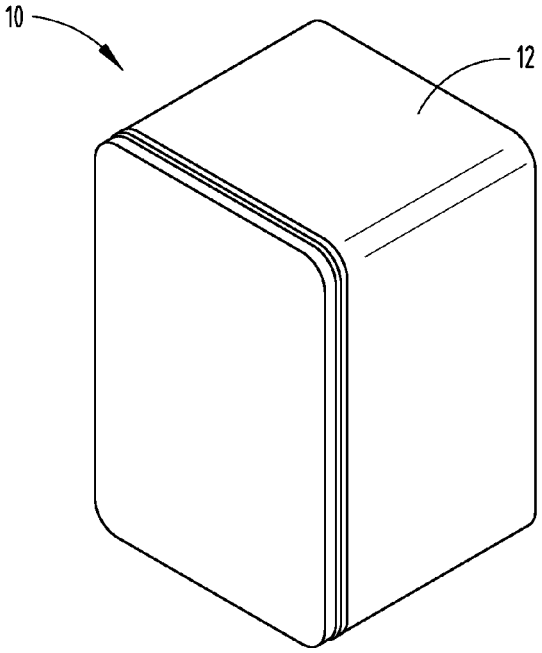
FIG. 1 is a top perspective view of one embodiment of a sealing assembly for a refrigerator.

For purposes of description herein the terms "upper," "lower," "right," "left," "rear," "front," "vertical," "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-4A, reference numeral 10 generally refers to a sealing assembly for a refrigerator 12 that includes a refrigerator cabinet liner 14 defining a receiving slot 16 having thermal breaks disposed therein. A flexible seal 18 includes a flange 20 disposed in the receiving slot 16 and a magnetic portion 22. A door 24 is adapted for abutment with the flexible seal 18 proximate the magnetic portion 22, thereby forming a substantially airtight compartment inside the refrigerator 12.

The various embodiments of the sealing assembly 10 as disclosed herein are generally designed to provide a tight thermal seal between the door 24 of the refrigerator 12 and the refrigerator cabinet liner 14. The sealing assembly 10 is generally defined for use with any of a variety of refrigerator constructions. The refrigerator 12 depicted in FIG. 1 is exemplary only and not meant to be limiting. As the refrigerator 12 is shown for illustrative purposes, it will be understood by a person having ordinary skill in the art that the sealing assembly 10 could be used on a refrigerator 12 having a side-by-side door configuration, a top freezer mount configuration, a bottom freezer mount configuration, etc. Traditional gasket systems oftentimes include a sealing system that is disposed on the door 24 of the refrigerator cabinet. In the embodiments as disclosed herein, the flexible seal 18 is generally disposed on the refrigerator cabinet liner 14, such that the door 24 does not include any form of seal at all, but instead includes an abutment portion 30 with conductive properties configured to engage the magnetic portion 22 of the sealing assembly 10. The magnetic portion 22 ensures a snug fit between the door 24 and the refrigerator cabinet liner 14.

Figure 2:
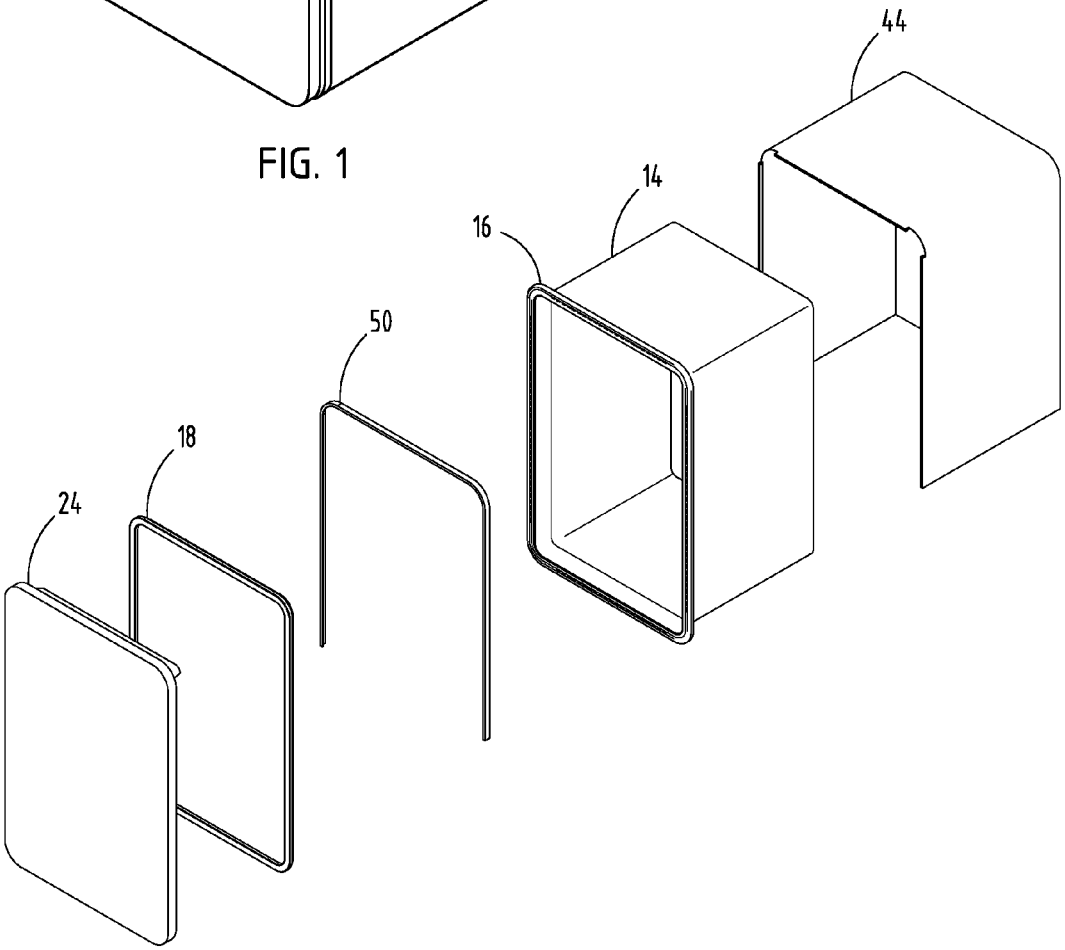
FIG. 2 is a top perspective view of an exploded view of the sealing assembly of FIG. 1.
Figure 3:
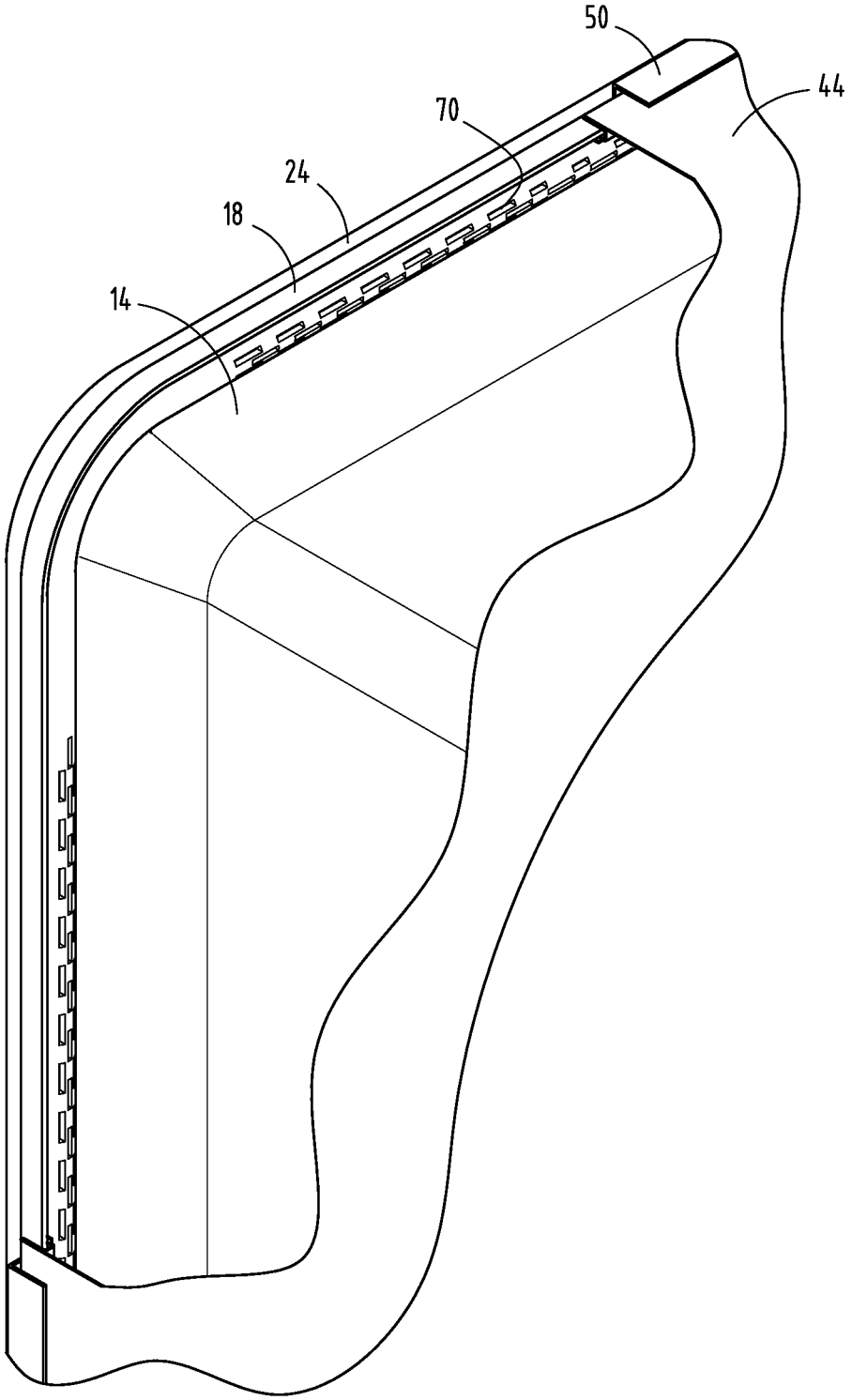
FIG. 3 is a top perspective partial view of a portion of a sealing assembly of the present invention.

Referring again to FIG. 1, the sealing assembly 10 is generally designed to have a substantially sleek profile with a highly efficient thermal seal 40 to provide an aesthetically pleasing appearance to a consumer. As illustrated in FIG. 2, the refrigerator 12 defines a cabinet 42 having an exterior wrapper 44 that extends around the cabinet liner 14. Similarly, the door 24 includes an inner door liner 46 and an outer door wrapper 48. The flexible seal 18 is adapted for connection with the receiving slot 16 that is disposed in and formed as a portion of the cabinet liner 14. A fascia member 50 extends over the exterior wrapper 44 of the refrigerator 12 and the cabinet liner 14, and assists in providing an aesthetically pleasing view to the consumer and at the same time maintains a connection between the cabinet liner 14 and the exterior wrapper 44 of the cabinet 42. The fascia member 50 includes an exterior portion 52, as well as a liner engagement portion 54, that extends substantially orthogonally from the exterior portion 52. It is also contemplated that the fascia member 50 can be omitted from the sealing assembly 10. The exterior portion 52 is engaged with the exterior wrapper 44 via adhesive, mechanical fasteners, etc., while the liner engagement portion 54 abuts the cabinet liner 14. The fascia member 50 may also include a similar color and material to the exterior wrapper 44, or may be constructed from a different material, such as stainless steel, plastic, etc.

Figure 4:
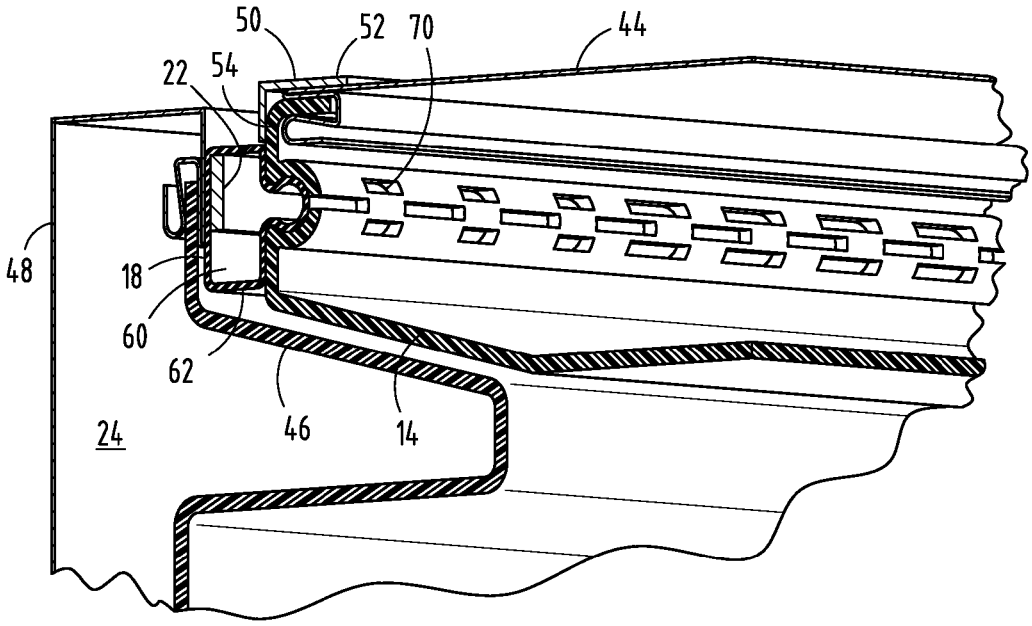
FIG. 4 is a side perspective view of one embodiment of a sealing assembly of the present invention.
Figure 4A:
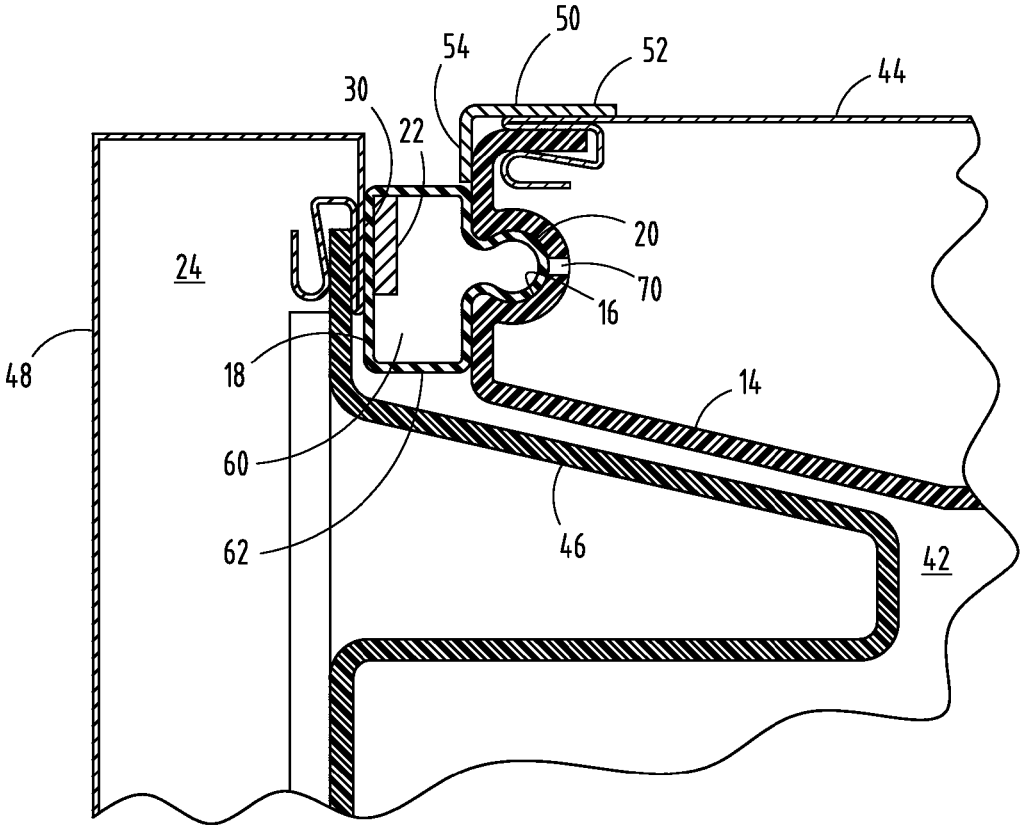
FIG. 4A is a side elevational view of the sealing assembly of FIG. 4.

As generally illustrated in FIGS. 4 and 4A, the flexible seal 18 generally defines an elongate tubular gasket 60. The flange 20 extends from a body portion 62 of the elongate tubular gasket 60 and is adapted to be received in the receiving slot 16. The flange 20 may take on a variety of constructions, as disclosed herein. Likewise, the receiving slot 16 may take on a variety of constructions that are substantially complementary to the general shape of the flange 20. In addition, the magnetic portion 22, as illustrated in FIGS. 4 and 4A, is disposed inside the elongate tubular gasket 60. The magnetic portion 22 may include a long magnetic strip, a plurality of shorter magnetic members, etc. It is contemplated that the magnetic portion 22 can be connected to the elongate tubular gasket 60 in a variety of ways, such as being thermal welded or adhered, inside the elongate tubular gasket 60 to maintain position inside the elongate tubular gasket 60. The flexible seal 18 is designed to contact the abutment portion 30 of the door 24, which is disposed proximate an outer periphery of the door 24. It is contemplated that the outer periphery of the door 24 will be integrated with the outer door wrapper 48 that extends around the inner door liner 46 of the door 24. It is also contemplated that the outer door wrapper 48 will include metallic properties, such that the outer door wrapper 48 is attracted to the magnetic portion 22 through the flexible seal 18. Accordingly, when the door 24 engages the magnetic portion 22, the magnetic portion 22 and the outer door wrapper 48 of the door 24, abut and are attracted as a result of the attraction of the magnetic portion 22 to the metallic properties of the outer door wrapper 48. Alternatively, the abutment portion 30 may include a non-integral member that is adhered or otherwise connected to the door 24, but which includes metallic properties to promote attraction between the abutment portion 30 and the magnetic portion 22 disposed in the flexible seal 18.

Figure 5:
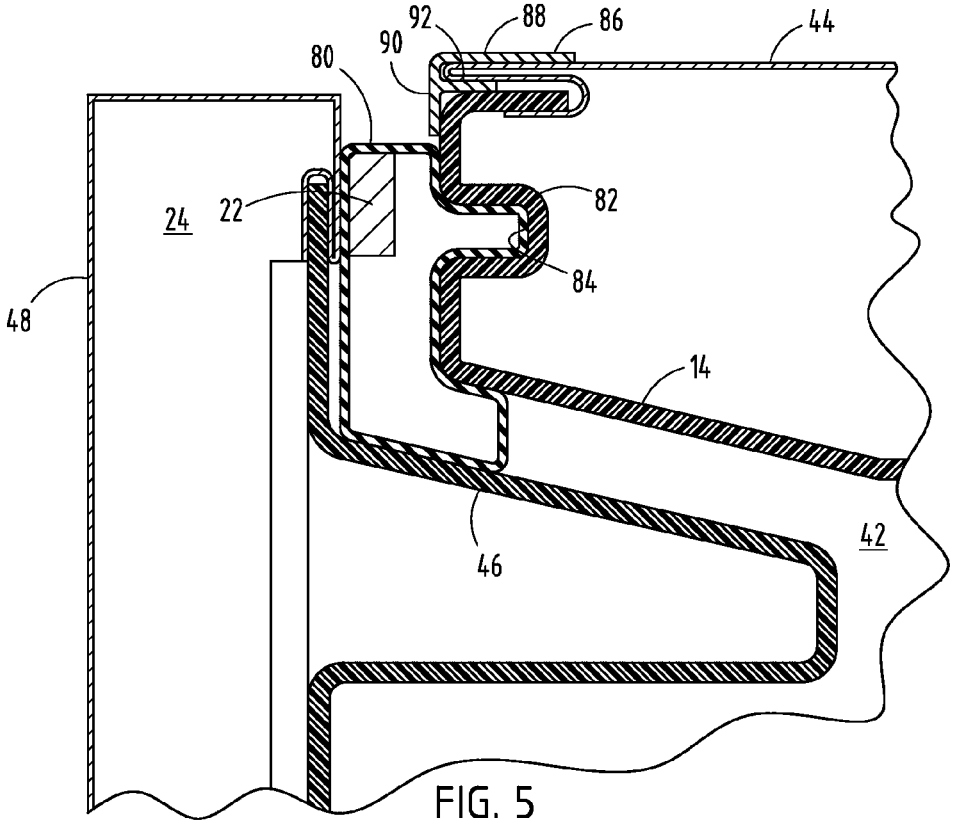
FIG. 5 is an enlarged side cross-sectional view of another embodiment of a sealing assembly of the present invention.
Figure 6:
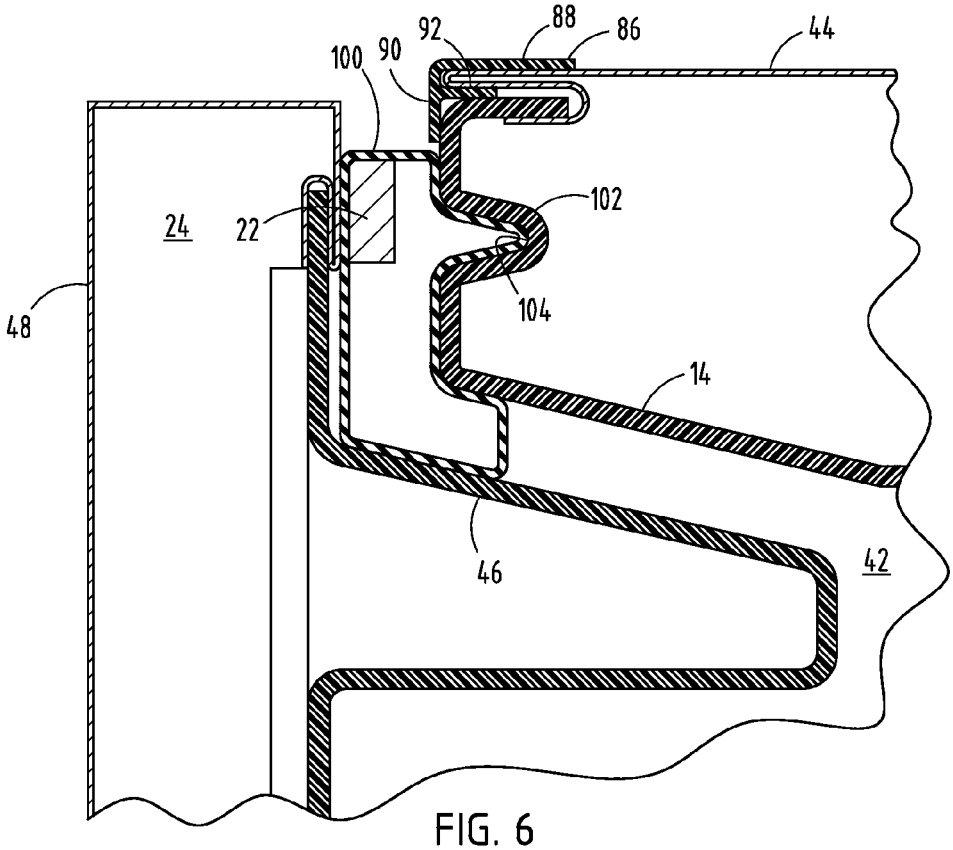
FIG. 6 is an enlarged side cross-sectional view of yet another embodiment of a sealing assembly of the present invention.

In the illustrated embodiment of FIGS. 4 and 4A, the receiving slot 16 of the sealing assembly 10 is comprised of a polymeric material and includes an at least partially circular cross-section. It is generally contemplated that the receiving slot 16 can include rows of thermal breaks 70 linearly oriented in the receiving slot 16. The rows of thermal breaks 70 are designed to increase the effective conductive length with which heat is transferred along the cabinet liner 14. In the illustrated embodiment, there are three rows of thermal breaks 70 that extend through the receiving slot 16. However, it is contemplated that any number of thermal breaks 70 having a variety of sizes could be utilized. During assembly, the flange 20 of the flexible seal 18 is inserted into the substantially circular cross-section of the receiving slot 16 and retained therein by adhesive, friction (such as an interference fit or snap fit connection), or other suitable fastening means. As generally illustrated in FIGS. 4-6, the magnetic portion 22 extends through the flexible seal 18 at an upper outside corner thereof. As shown in FIG. 4A, the magnetic portion 22 is configured to attract the metallic outer door wrapper 48 of the door 24, keeping a substantially tight seal between the flexible seal 18 and the outer door wrapper 48 of the door 24.

Referring now to FIG. 5, in yet another embodiment of the present invention, the sealing assembly 10 includes a flexible seal 80 having a substantially rectangularly-shaped flange 82 adapted for engagement with a complementary rectangular receiving slot 84 disposed in the cabinet liner 14 of the refrigerator 12. A fascia member 86 engages the cabinet liner 14 and includes an exterior portion 88 and a liner engagement portion 90. An intermediate tab 92 extends from the liner engagement portion 90 between the cabinet liner 14 and the exterior wrapper 44. The intermediate tab 92 assists in providing a strong frictional connection between the cabinet liner 14 and the exterior wrapper 44.

Referring now to FIG. 6, in yet another embodiment of the present invention, the sealing assembly 10 includes a flexible seal 100 having a triangularly-shaped flange 102 adapted for insertion into a receiving slot 104 that also includes a triangular cross-section. Other sealing assembly constructions are also contemplated that include various other geometric configurations or combinations of geometric configurations.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

What is claimed is:

1. A sealing assembly for a refrigerator comprising:

a refrigerator cabinet liner defining a receiving slot having a plurality of thermal breaks disposed therein;

an elongate tubular gasket including a magnetic portion and an engagement projection disposed in the receiving slot;

a cabinet door adapted for abutment with the elongate tubular gasket proximate the magnetic portion, thereby forming a substantially airtight compartment inside the refrigerator; and an L-shaped fascia member disposed adjacent the elongate tubular gasket, wherein the L-shaped fascia member abuts a cabinet wrapper and includes an intermediate tab that extends between the cabinet liner and the cabinet wrapper.

2. The sealing assembly of claim 1, wherein a portion of the receiving slot includes a rectangular cross-section.

3. The sealing assembly of claim 1, wherein the magnetic portion generally defines a magnetic strip disposed inside the elongate tubular gasket.

4. The sealing assembly of claim 1, wherein at least a portion of the receiving slot includes a substantially circular cross-section.

5. The sealing assembly of claim 1, wherein at least a portion of the receiving slot includes a V-shape defined by first and second walls.

6. The sealing assembly of claim 1, wherein the magnetic portion comprises a magnetic strip is disposed inside the elongate tubular gasket.

* * * * *